US009332883B1

(12) United States Patent
Angelella

(10) Patent No.: US 9,332,883 B1
(45) Date of Patent: May 10, 2016

(54) WATERPROOF SHOWER RECEPTOR MODULE AND METHOD OF SHOWER CONSTRUCTION

(76) Inventor: John Charles Angelella, Allentown, PA (US)

( * ) Notice: Subject to any disclaimer, the term of this patent is extended or adjusted under 35 U.S.C. 154(b) by 1132 days.

(21) Appl. No.: 12/880,872

(22) Filed: Sep. 13, 2010

Related U.S. Application Data

(60) Provisional application No. 61/241,586, filed on Sep. 11, 2009.

(51) Int. Cl.
*A47K 3/00* (2006.01)
*A47K 3/40* (2006.01)

(52) U.S. Cl.
CPC .... *A47K 3/00* (2013.01); *A47K 3/40* (2013.01)

(58) Field of Classification Search
CPC ..... A47K 3/00; A47K 3/40
USPC ..... 4/612–614, 596
See application file for complete search history.

(56) References Cited

U.S. PATENT DOCUMENTS

| | | | | |
|---|---|---|---|---|
| 5,913,777 | A | 6/1999 | Gerber | |
| 6,003,169 | A * | 12/1999 | Davis, Jr. | 4/613 |
| 6,643,863 | B1 * | 11/2003 | Gerber | 4/613 |
| 8,112,831 | B2 * | 2/2012 | Cook | 4/613 |
| 8,181,286 | B2 * | 5/2012 | Cook | 4/613 |
| 8,789,316 | B2 | 7/2014 | Cook | |
| 2006/0026752 | A1 * | 2/2006 | Torres | A47K 3/40 4/613 |
| 2006/0213006 | A1 * | 9/2006 | Rush et al. | 4/613 |
| 2008/0222793 | A1 | 9/2008 | Cook | |
| 2008/0222794 | A1 | 9/2008 | Cook | |
| 2008/0222795 | A1 | 9/2008 | Cook | |
| 2008/0222796 | A1 | 9/2008 | Cook | |
| 2008/0222797 | A1 | 9/2008 | Cook | |
| 2008/0222891 | A1 | 9/2008 | Cook | |
| 2010/0043136 | A1 * | 2/2010 | Michael | 4/613 |

* cited by examiner

*Primary Examiner* — Huyen Le
(74) *Attorney, Agent, or Firm* — Baker & Hostetler LLP

(57) ABSTRACT

There is disclosed a prefabricated shower receptor module having a floor with a drain opening and a plurality of peripheral edges. The floor is bound along at least one peripheral edge by a side flange such that an integral one-piece module is created. In one embodiment, a prefabricated seat is bonded to a peripheral edge of the floor. The module is constructed from a waterproof matrix material suitable for applying shower tile or stone directly thereon. Previously set tile or stone can be removed from the matrix material, and new tile or stone reapplied, without damaging the module.

23 Claims, 12 Drawing Sheets

WATERPROOF SHOWER RECEPTOR MODULE AND METHOD OF SHOWER CONSTRUCTION

CROSS-REFERENCE TO RELATED APPLICATIONS

This application claims the benefit of U.S. Provisional Patent Application Ser. No. 61/241,586, filed Sep. 11, 2009, the disclosure of which is hereby incorporated by reference as if set forth in its entirety herein.

TECHNICAL FIELD

There is described herein a prefabricated shower receptor module, and particularly, an integral one-piece waterproof shower receptor with drain connectivity, capable of being mounted directly onto floor joists, or onto a subfloor or other floor, and having surfaces for applying shower tile or stone thereon, wherein previously set tile can be removed, and new tile reapplied, without damaging the module.

BACKGROUND

Prefabricated shower modules are known. Known prefabricated shower modules are generally designed with finished surfaces, or with tile ready surfaces. However, known prefabricated shower modules that provide integrated drain assemblies are limited by its design to one type of drain connection, which is problematic for installations that have limited access to plumbing underneath the shower area or when an alternative plumbing connection is required or is more efficient. The use of drain assemblies that accommodate either a solvent weld or a compression connection, designed typically to fit with prefabricated shower modules with finished surfaces such as cultured marble and acrylic, is not known to be available in a tile ready surface application since those drain assemblies do not incorporate an adjustable strainer in its design. This, coupled with the relative higher cost, weight, module design and material composition, limits the current use of prefabricated shower modules with tile ready surface.

Similarly, known prefabricated shower modules with a tile ready surface involve inefficient installation procedures, are not subject to renewable features for subsequent tile installation and require multiple steps in the field for the installation of seating surfaces. Large tiles or slabs, which minimizes grout lines and reduces on-going maintenance for the homeowner, generally cannot be used with known prefabricated modules with tile ready surface unless substantial time and labor is invested to modify the slope of the module. Conventional slope modification techniques are difficult, and if not performed correctly, can result in the diminished functionality of the shower module. Further, many prefabricated shower modules are designed and made with materials that require the use of a subfloor to limit flexing and provide structural integrity to the module. Installation on an underlying substrate such as concrete or plywood, raises the height of the shower, and can be problematic for installations that require a barrier free or lower entry, such as in handicap accessible shower areas. Many existing prefabricated shower modules with a tile ready pan are made from flexible and soft materials, such as expanded polystyrene. In order to create adequate bonding with the tile, epoxy type adhesives are typically used during the initial tile installation process, creating a substantially permanent bond between the tile and original shower module. Tiles removed with conventional methods may damage the underlying module, resulting in potential leakage and a substrate that can harbor the growth of bacteria and mold. As a result, restoration or complete replacement of shower tile may involve removal of the existing shower module and installation of an entirely new module.

Installation of shower seating to current prefabricated shower modules generally requires a separate seating surface to be attached in the field either into or adjacent to the pan of the prefabricated module. A contractor must create a seal between the seat, pan and adjacent walls to insure a watertight shower area and the seat must be pitched such that water runs off the seat surface and away from the walls of the shower. Furthermore, for showers incorporating multiple shower heads and water jets, the ability to integrate multiple 2" drains or a larger drain assembly with conventional prefabricated shower modules can be difficult or problematic. Also, current glue-in drain assemblies used with prefabricated modules require the use of fast setting solvents, making a substantially permanent connection between the drain assembly and drain pipe, and thereby hinder a contractor's ability to move the module after the glue has been applied, or to correct a leak under the module.

The present invention addresses these and other problems in the prior art by providing an integral one-piece waterproof shower receptor with drain connectivity that allows for the efficient construction of a shower and seat area while avoiding the disadvantages present in conventional prefabricated shower modules.

SUMMARY

A prefabricated integral one-piece waterproof shower receptor module comprises a pitched floor with a drain opening and side flanges. A drain assembly for use with the module is also provided. The module has a pitched floor that is lightweight, rigid and non-porous, creating a renewable substrate wherein previously applied tiles can be removed without damaging the module, even when the tiles are removed by force (e.g., hammer and chisel). New tiles can then be applied to the existing module.

The top surface of the module defines the pitched floor, and has a rough texture to improve the bond to the tile adhesive. The underside, or bottom surface, of the module is substantially flat so that it is in substantial contact with the floor joists, subfloor or floor (whichever is present at the site). In one embodiment, a seat of the same material as the floor portion of the module is integrally bonded to the floor, such as at an edge thereof. Side flanges, made from a relatively rigid material such as fiberglass, are chemically bonded in a vertical orientation to selected edges of the floor and to the seat to create a waterproof barrier around the module. Each flange is of minimal thickness to allow concrete backer board, or so-called "green board" (water resistant drywall) to be placed over (i.e., overlap) the flanges and secured, above the top surface of the flanges, to adjacent framing studs or an existing wall, so as to provide a substantially flat surface on the front of the backer board or wall board for tile application. In another embodiment, there is a curb integrally molded to one side edge of the floor. The curb is of the same material as the remainder of the module so that it can accept tile. In another embodiment, there is an edge that defines a barrier free entry to the shower.

The drain assembly is configured to be received in the drain opening of the shower receptor module and engage a drain pipe. The drain assembly includes a bottom and top portion, a secondary drain system and a strainer; the strainer is preferably vertically adjustable to allow installation of tiles of varying thickness on the module floor. Various methods for attaching the drain to a drain pipe are disclosed.

Installation of the shower receptor module involves first securing the drain assembly to the drain opening. Once the entire drain assembly is secured to the drain opening, the shower receptor module is set in place, over the drain pipe, so that the bottom surface of the module lies upon the floor joists, subfloor or floor, and so that the edges substantially abut the framing studs or existing wall. From the top side of the shower module, the drain assembly is tightened over the drain pipe and the height of the strainer is adjusted according to tile height. The backer board or green board is then placed on the framing studs/existing wall, such that the board overlaps the side flanges of the shower receptor module. Tile is applied to the floor and board using thin-set.

The shower receptor module of the present invention provides savings of both time and material, and a method for a safer and easier installation in the field. Installation of an integral one-piece shower receptor module eliminates the time to construct and install a separate seat component, if desired, and eliminates the use of chemical sealants that are necessary to insure a water tight connection between the seat and shower. Direct placement of the module on floor joists enables a lower entry point to the shower and is especially helpful for minimizing costs to transition the bathroom floor to the shower floor in handicap accessible shower applications. Further, direct placement of the module on floor joists coupled with an integrated trough drain in the front of a uni-directionally sloped module, permits a further reduced or lower entry for barrier free modifications, substantially eliminating the need to transition the bathroom floor to the adjacent shower floor. Eliminating the need to transition the bathroom floor to the shower floor permits health institutions including nursing homes to comply with maximum ADA slope requirements relating to floor surfaces for rolling wheelchairs throughout their facilities. Conversely, an integrated trough drain in the back of the module with a one directional slope permits a higher entry at the front and eliminates the need to use conventional curbs or thresholds, without worry of water running out of the shower area into the adjacent bathroom area. A trough drain in the back or middle of the module incorporating a one or two directional slope, respectively, also provides a cost effective solution for handling a greater flow of water for showers that may incorporate multiple shower heads and watering jets without the need to modify conventional 2" drain piping to a larger diameter. Alternatively, for handling a greater flow of water, the module can incorporate multiple shower drains using standard 2" schedule 40 fittings with conventional round or square strainers, eliminating the need to modify the plumbing to a larger diameter underneath the drain openings. Further still, the need to modify copper or steel piping to PVC or ABS, or the need to have direct access to plumbing underneath the shower area, is eliminated by using the disclosed drain assembly. The rigid substrate of the shower floor allows a nut and washer drain assembly to be used with the disclosed invention and tightened without worry of deforming the floor of a module that is constructed from a soft (e.g., polystyrene) material.

The non-porous and rigid substrate of the disclosed shower module also permits a trough drain to be integrated within a one or two directional sloped floor and enables the use of larger tiles and slabs that require little or minimal grout lines and provide, after tiling, a better surface environment to inhibit growth of mildew and mold, and for easier on-going maintenance. A water based thin-set for adhering tile and stone can be used with the disclosed substrate, making tile installation more cost effective, safer and easier than other tile ready modules that use a two part epoxy adhesives which can emit dangerous vapors and odors. Two part epoxy adhesives are known for setting up or curing too quickly and can hinder an installer's ability to re-position tile placed on the surface of the module, if needed. The shower module of the present invention also eliminates the need for the demolition and replacement of the previous shower module during re-tiling applications and is substantially lighter, up to 45%, than other rigid and non-porous prefabricated shower modules, making it easy to handle and install by both contractors and do-it-yourself homeowners.

DETAILED DESCRIPTION OF ILLUSTRATIVE EMBODIMENTS

Figure 1:
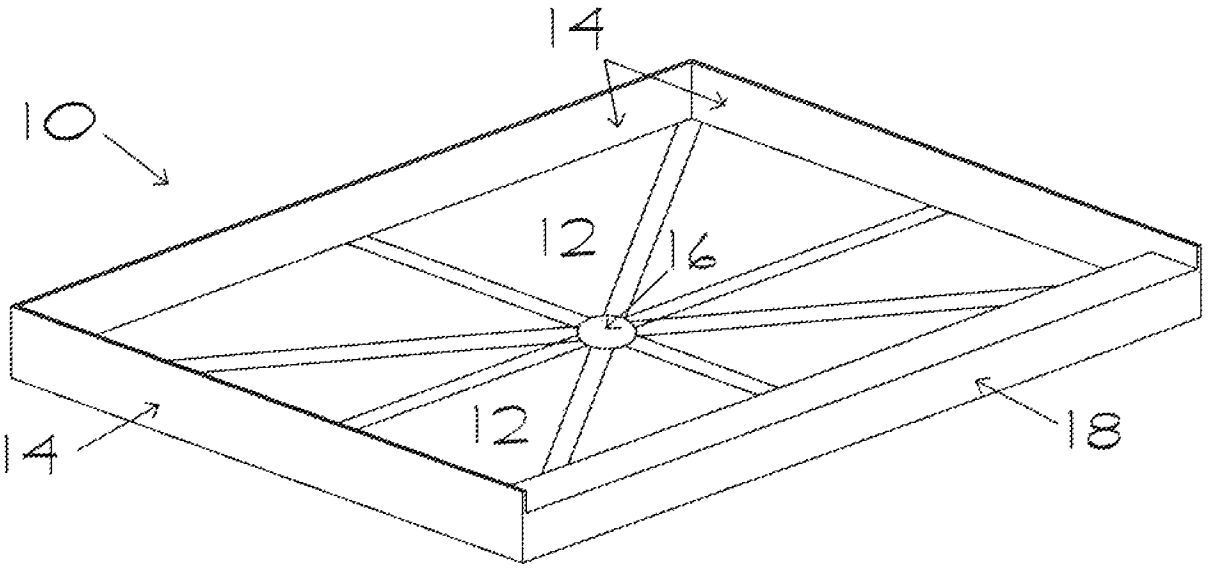
FIG. 1 is a front/top perspective view of a shower receptor module in accordance with an embodiment of the present invention.
Figure 2:
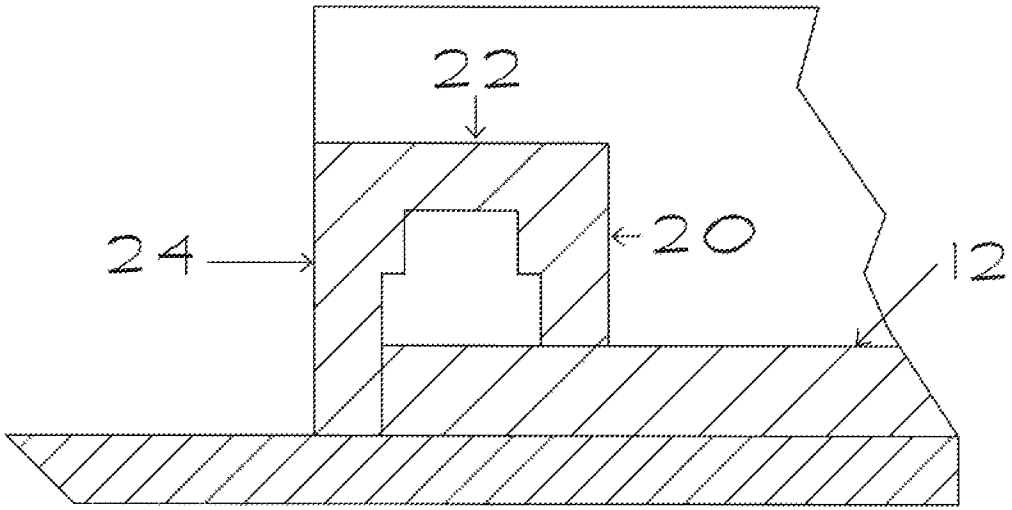
FIG. 2 is a side cross-sectional view of a curb of the shower receptor module of FIG. 1.
Figure 3:
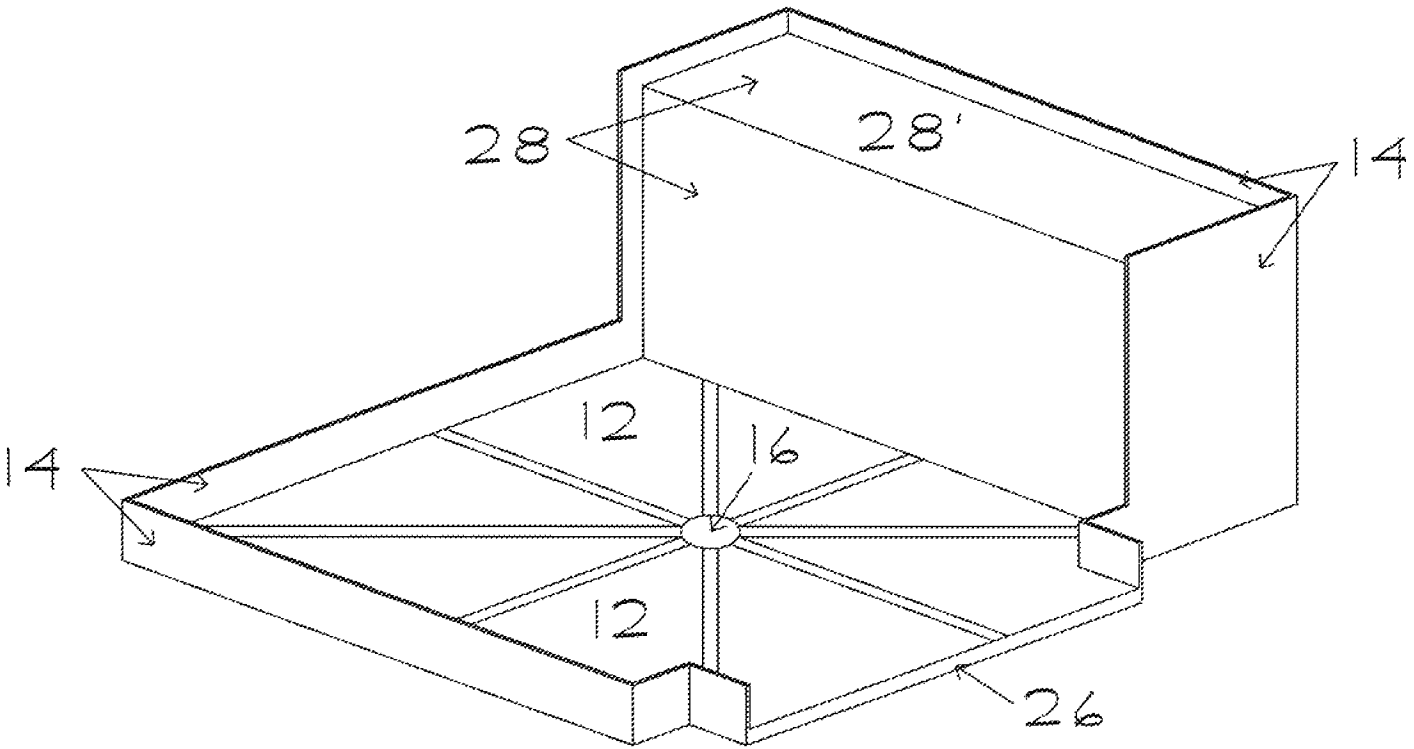
FIG. 3 is a front/top perspective view of a shower receptor module with seat in accordance with an alternative embodiment of the present invention.

Referring to the drawings, wherein like numerals indicate like elements, there is shown in FIG. 1 an exemplary prefabricated integral one-piece waterproof shower receptor module 10, according to one embodiment of the invention. Shower receptor module 10 includes a floor 12, side flanges 14, a drain opening 16 and a curb 18. Floor 12, side flanges 14 and curb 18 are bonded to form an integral one-piece waterproof shower receptor module. As shown in FIG. 2, the curb 18 includes an inner vertical curb surface 20, a horizontal curb surface 22 and an outer vertical curb surface 24 to create a barrier between the shower receptor module and the outside bathroom area. More than one curb, or multiple curbs or thresholds, including those designed for placement of full or partial shower glass walls or doors, are considered within the scope of this invention. However, the curb 18 is optional and in another embodiment, e.g., as illustrated in FIG. 3, there is no curb and instead one edge 26 of the floor has a barrier-free entry from the bathroom to the shower area. FIG. 3 also depicts a seat 28, with seating surface 28', bonded with the floor 12 and side flanges 14 to form an integral one-piece waterproof shower receptor module with seating area. The seating surface 28' incorporates a downward slope from back to front at ¼" per foot, however, any suitable slope is considered within the scope of this invention. Furthermore, other seating or support configurations including corner designs and foot supports are considered within the scope of this invention.

Figure 4:
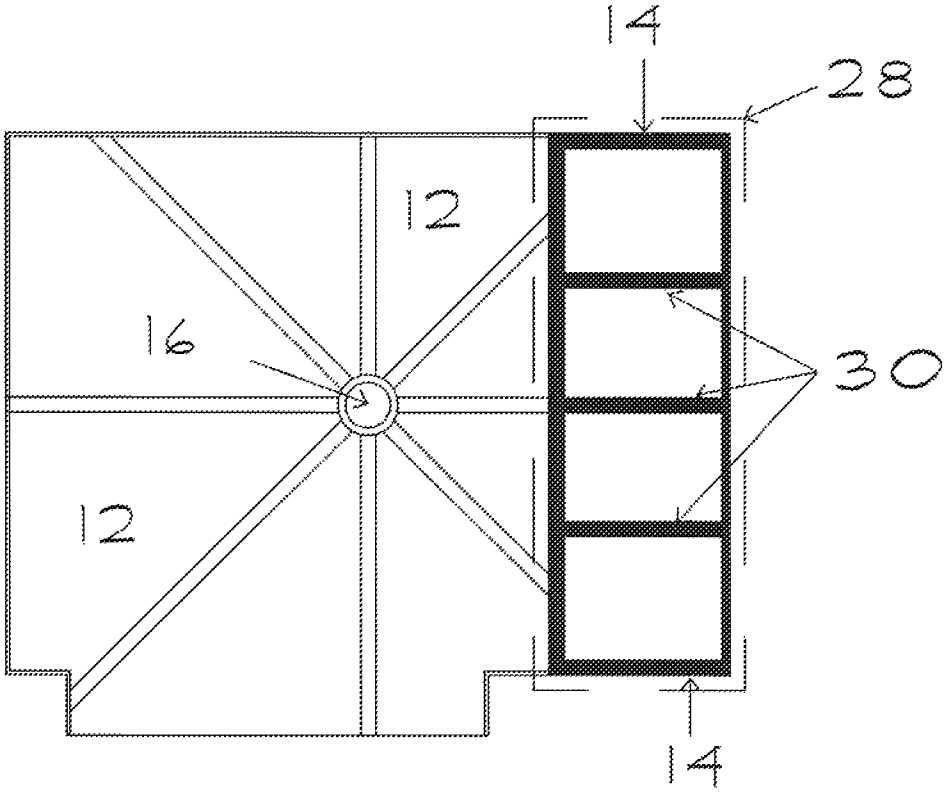
FIG. 4 is a top cross-sectional view of the shower receptor module of FIG. 3.

All components, floor 12, side flanges 14, seat 28, if desired, and curb 18, if desired, are bonded together using an adhesive agent comprised of, for example, approximately 66.5% A-101-T-15S laminating resin manufactured by Ashland Chemicals, 33% HDK N20 fumed silica manufactured by Wacker Chemie and 0.5% Cadox M-50A initiator manufactured by Akzo Nobel, by volume. In FIG. 4, the seat 28 is shown with internal support structures 30 that extend vertically from a plane parallel to the bottom surface of the floor 12 to the bottom of the seating surface 28'.

Floor 12 and seat 28 are preferably fabricated from a non-porous, rigid, lightweight, and waterproof matrix material manufactured by an open mold process. In one embodiment, the matrix material is created with a high proportion, 50% to 55% by weight, of unsaturated polyester resin mixed with a filler comprised of relatively small particles, 99%<140 mesh, 98%<200 mesh and 91%<325 mesh, of recycled polyester resin, recycled aluminum trihydrate and recycled calcium carbonate material. Fiberglass mesh or fibers can be added to increase the tensile and flexural strength of the matrix material. A wetting agent, BYK-W 909 manufactured by BYK-Chemie USA, is preferably added during the mixing process of the lightweight matrix at a rate of 1 gram to 1 lb of resin which aids the flow of material during the open mold process. Cadox M-50A initiator is preferably added to the mixture at a ratio of 0.8 grams to 1 lb of resin to promote the hardening of the matrix and resulting in a finished matrix surface that provides optimal adhesion characteristics for bonding tile or stone. In another embodiment, the matrix material may be created with a higher proportion, 60% by weight, of unsaturated polyester resin mixed with 31% filler comprised of relatively small particles, 99%<140 mesh, 98%<200 mesh and 91%<325 mesh, of recycled polyester resin, recycled aluminum trihydrate and recycled calcium carbonate material, and 9% of #40 Perlite manufactured by Pennsylvania Perlite Corporation. The formulation in this embodiment eliminates the need for using BYK-W 909 or another wetting agent in the open mold process. The process includes agitation to remove air from the matrix. The matrix is cured for 24 hours and then the surface is sanded to roughen it so as to enhance adhesion characteristics.

Figure 5:
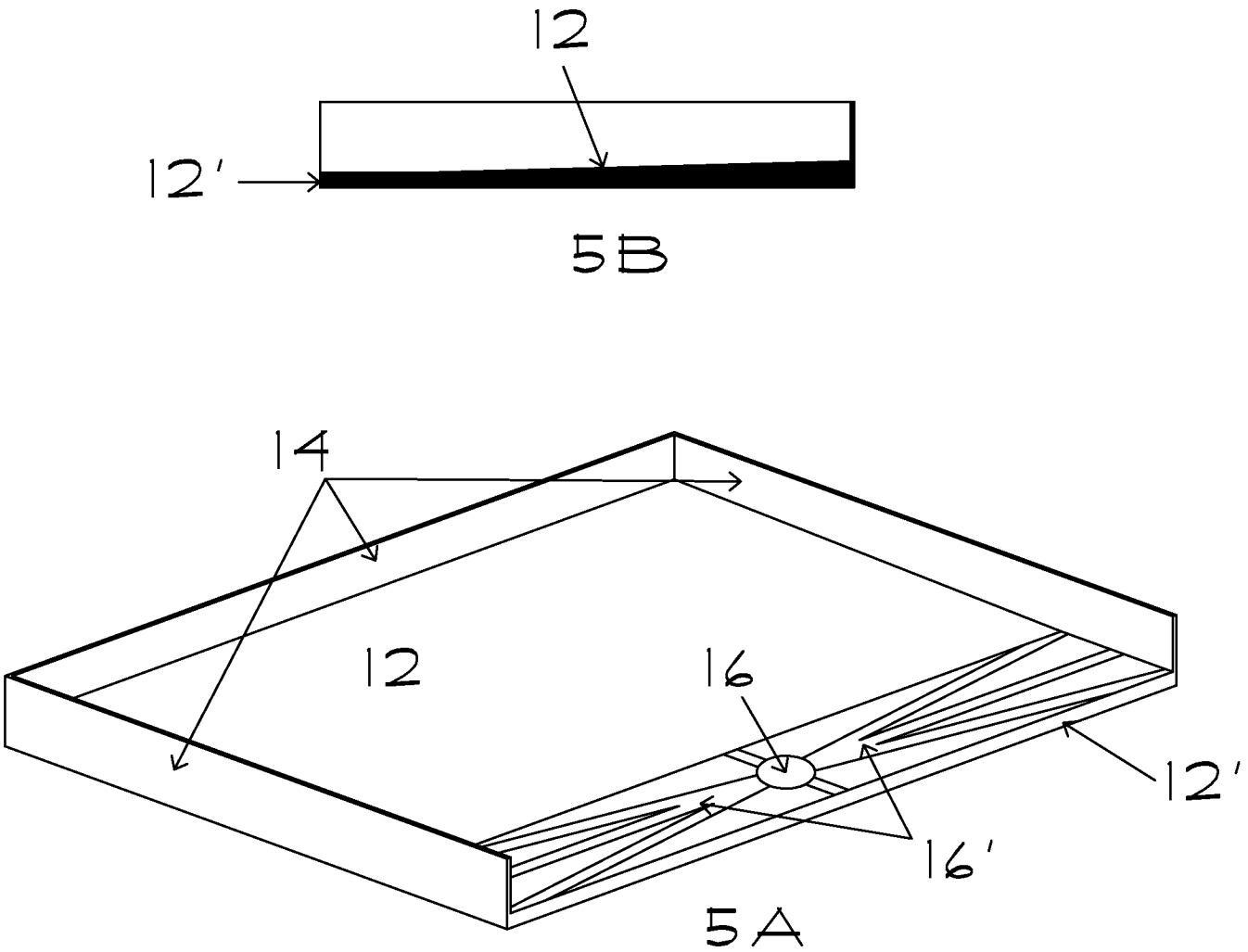
FIG. 5A is a front/top perspective view of a shower receptor module with one directional slope and drain opening in the front of the module, in accordance with an alternative embodiment of the present invention.
FIG. 5B is a side cross-sectional view of the shower receptor module of FIG. 5A.
Figure 6:
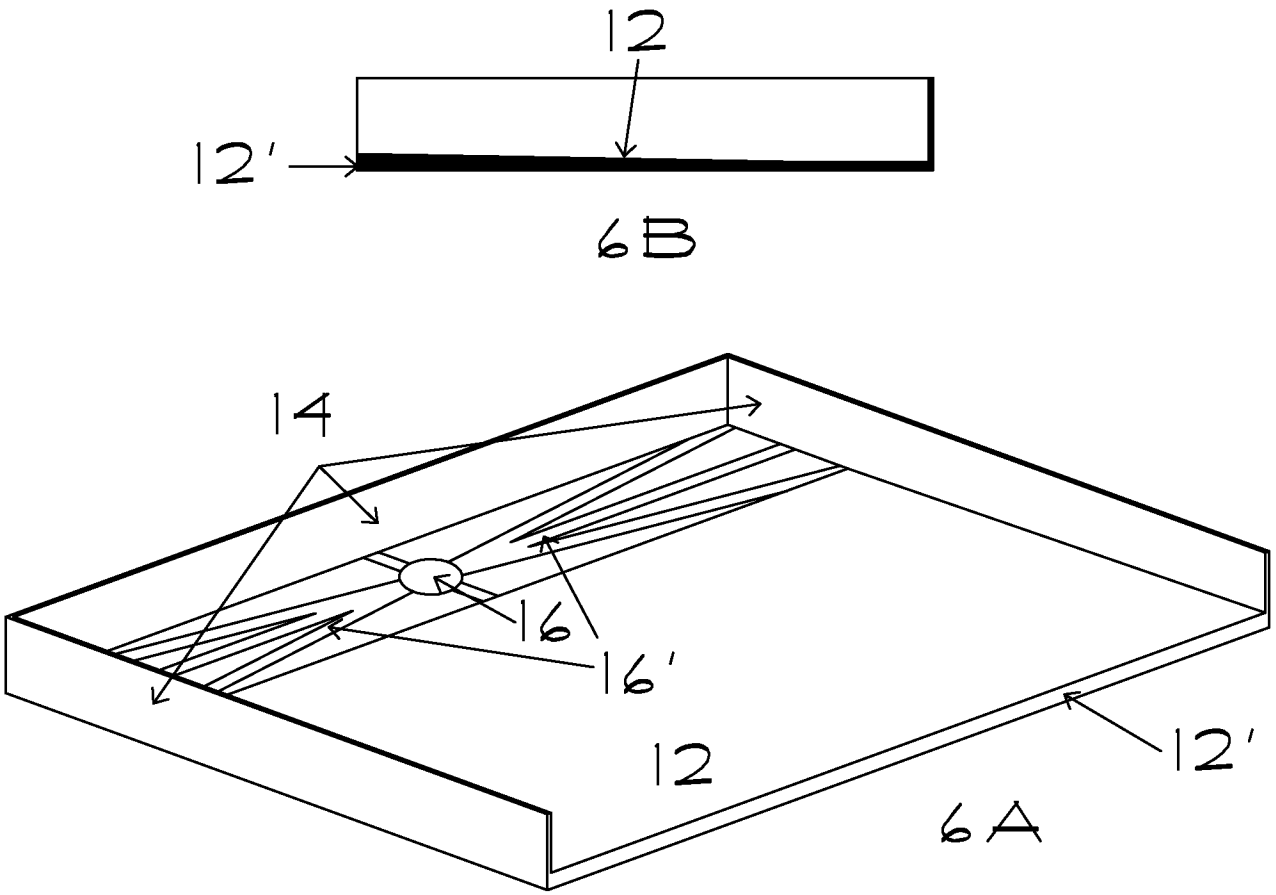
FIG. 6A is a front/top perspective view of a shower receptor module with one directional slope and drain opening in the back of the module, in accordance with an alternative embodiment of the present invention.
FIG. 6B is a side cross-sectional view of the shower receptor module of FIG. 6A.
Figure 7:
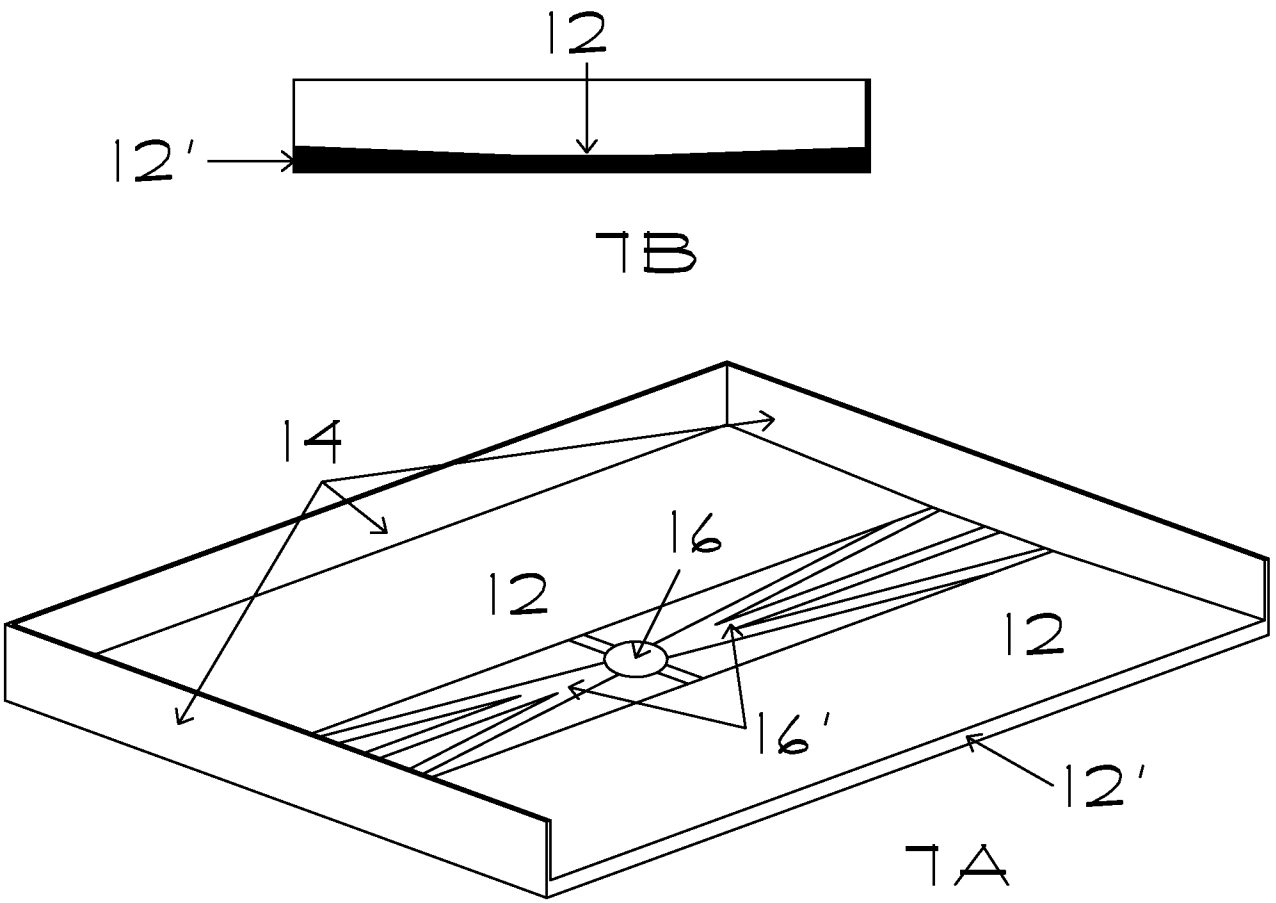
FIG. 7A is a front/top perspective view of a shower receptor module with one directional slope and drain opening in the middle of the module, in accordance with an alternative embodiment of the present invention.
FIG. 7B is a side cross-sectional view of the shower receptor module of FIG. 7A.

In one embodiment, the floor 12 is cast to a minimum thickness of approximately ½" at the drain hole and incorporates a ¼" per foot slope from drain hole to the outside perimeter of the floor, adjacent to the side flanges and, if applicable, adjacent to curbs, seats or opening as defined by the design; however, any suitable slope is considered within the scope of the invention. Further, floor 12 may include multiple drain openings and may take on various geometries for permitting water to flow from multiple directions. In an alternative embodiment, FIGS. 5 & 6, the floor 12 is cast with a one directional slope allowing the drain opening 16 to be located in the front, FIG. 5A-B, or back, FIG. 6A-B. In another embodiment, FIG. 7, the floor is cast with a two directional slope allowing the drain to be located between the front and back, or middle of the floor 12, FIG. 7A-B. To permit the handling of a greater volume of water, a trench or trough drain system 16', FIGS. 5-7, is cast into floor 12. The placement of drain opening 16 and trench drain system 16' in the front, back or between the front and back of the floor 12 will vary the thickness of the front edge of the floor 12' such that a barrier free entry can be provided, or an entry with a front step can be provided without the use of a conventional, raised curb 18. The use of a floor 12 with a one or two directional slope and trench drain system 16' eliminates the need to convert a standard 2" drain opening to a 3" drain opening for high water volume installations and provides for a tiling surface capable of receiving large sized tiles or slabs. Further, the floor 12 geometry make take on any shape and is not limited to what is shown or described herein.

Figure 8:
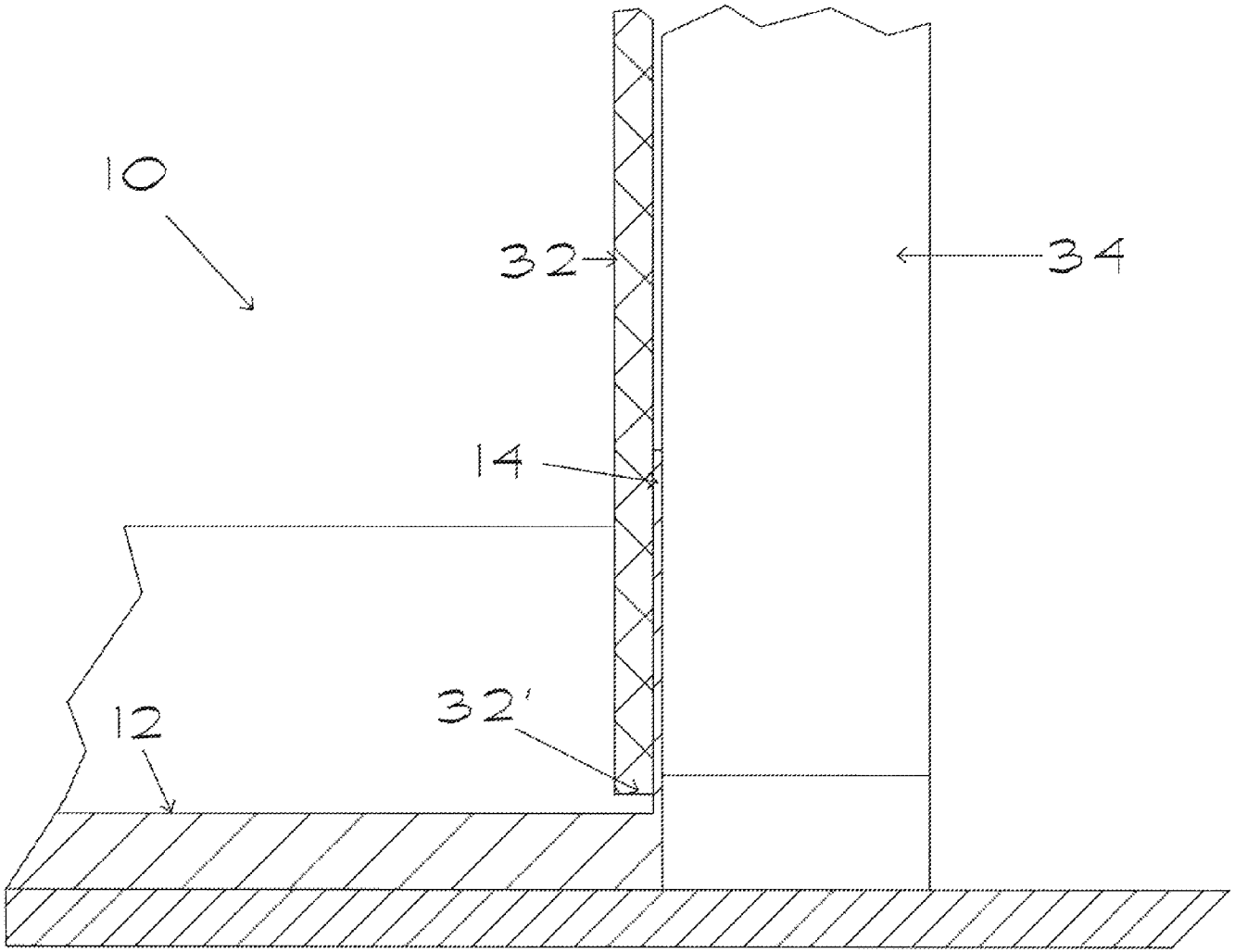
FIG. 8 is a side cross-sectional view illustrating an exemplary installation of backer board or green board within the shower receptor module of FIG. 1.
Figure 9:
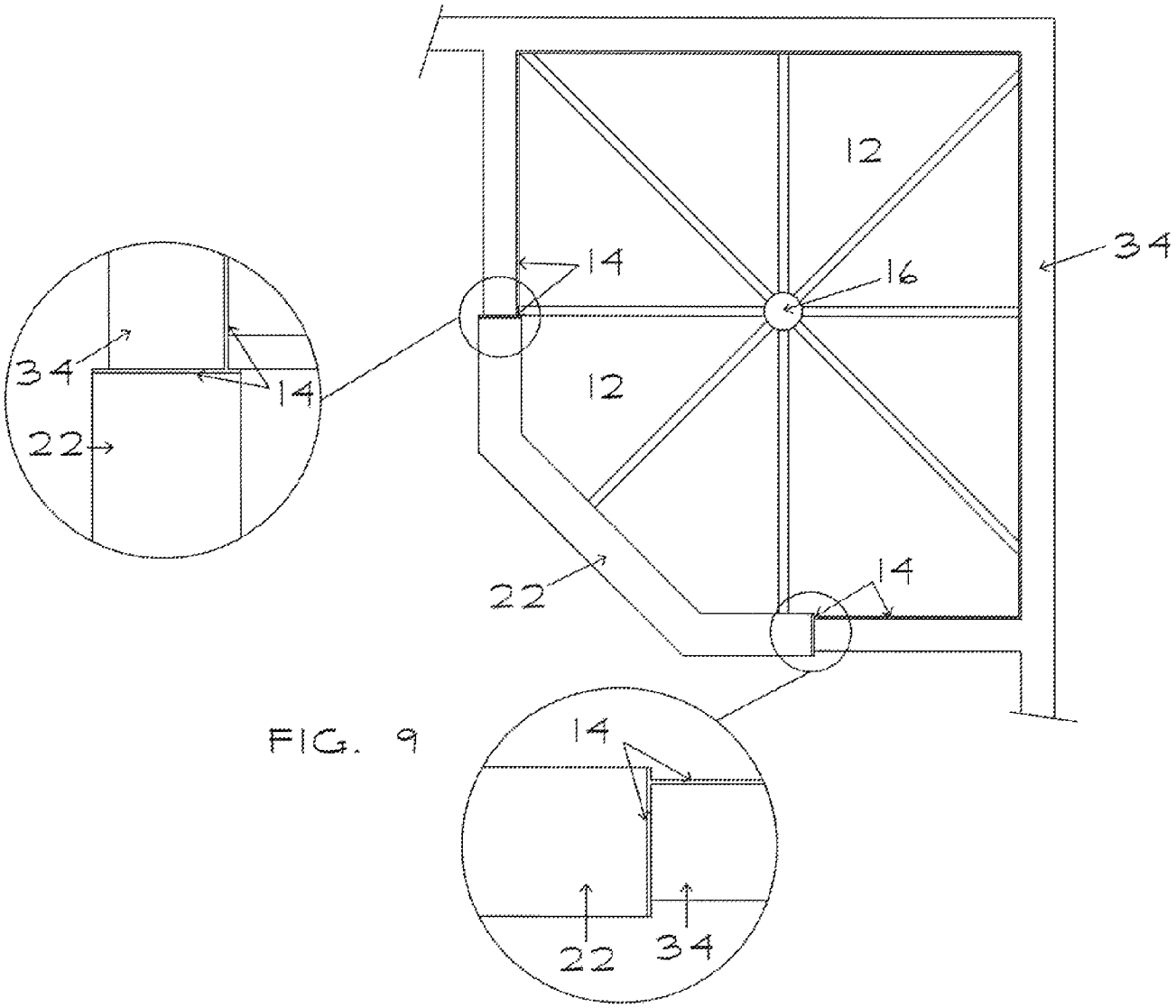
FIG. 9 is a top view of a shower receptor module with partial curb in accordance with an alternative embodiment of the present invention.

Side flanges 14 may be constructed from fiberglass or fiberglass reinforced plastic. Preferably, each flange 14 extends a minimum height of 1½" above the floor 12, if the shower receptor module is without a curb 18, or 1½" above the height of the curb 18. Side flanges 14 preferably also extend a minimum of 1½" above the seating surface 28' of the seat 28. Flange width preferably ranges from 1/16" to ⅛" thick. FIG. 8 illustrates the configuration of concrete backer board or green board 32 within the shower receptor module 10. The board 32 is placed over the side flanges 14, and is secured to framing studs 34 creating a substantially flat vertical surface for tile application. The bottom edge of the concrete backer board 32' preferably rests approximately ¼" or more above the floor 12. In one embodiment, as shown in FIG. 9, the horizontal curb surface 22 is set back into the interior of the floor 12 by preferably ½" to create a partial front curb application (e.g. where the curb 18, if desired, does not span the entire front edge or front edges of the floor 12). Side flanges 14 preferably extend along the horizontal surface formed by the set back to ensure a water-proof application. The set back permits easier installation and tiling of the shower receptor module with partial front curb by aligning the front surface of the backer board or green board 32 in plane with the inner vertical curb surface 20. In all embodiments, tile or stone can be installed directly onto the concrete back board 32, floor 12, and if applicable, curb 18 and seat 28, using, for example, FlexBond thin-set by Custom Building Products.

In another embodiment, the module 10 is factory coated with a smooth surface so as to provide a finished surface that does not require tiling.

Figure 10:
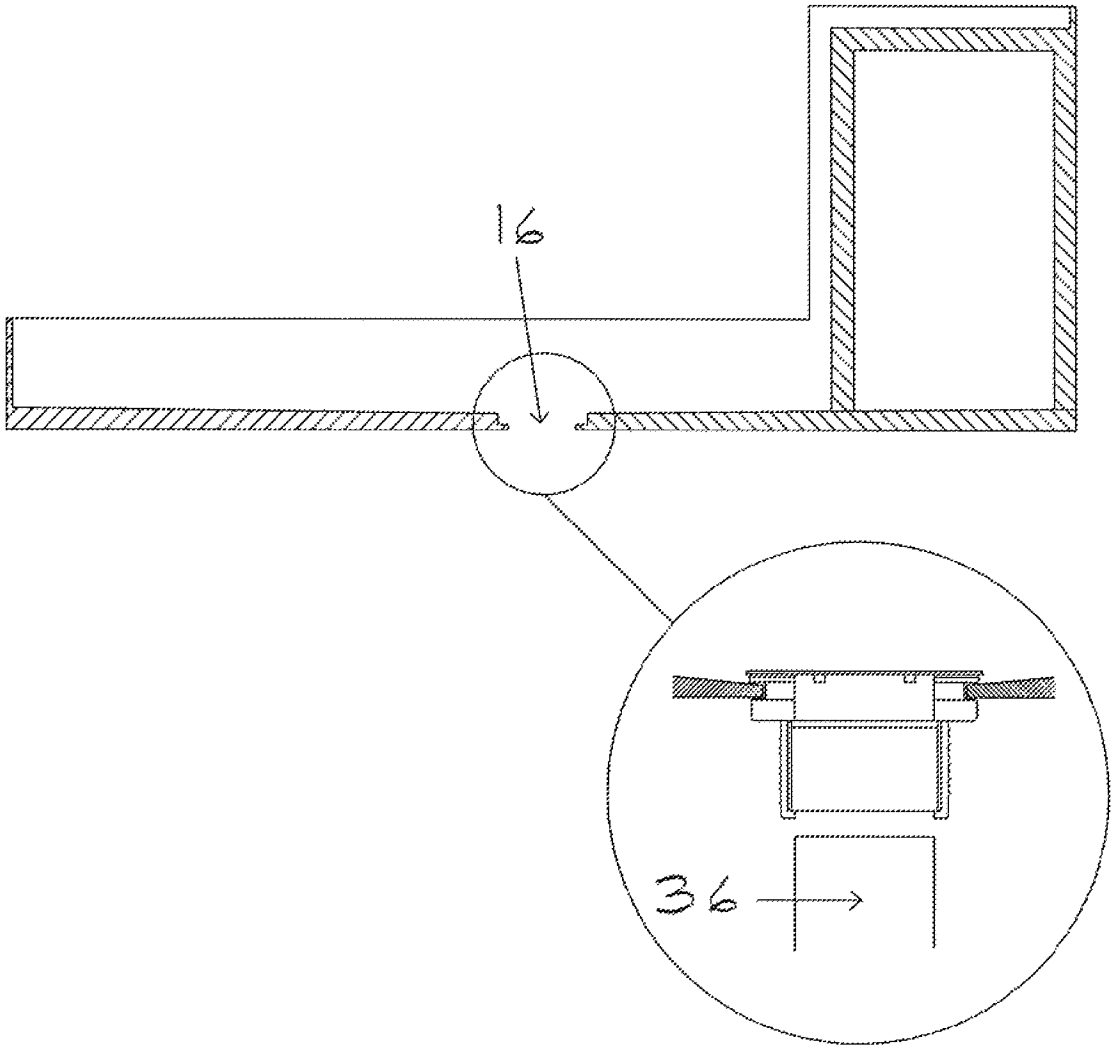
FIG. 10 is a cross-sectional and exploded view of the drain opening of the shower receptor module of FIG. 3.
Figure 11:
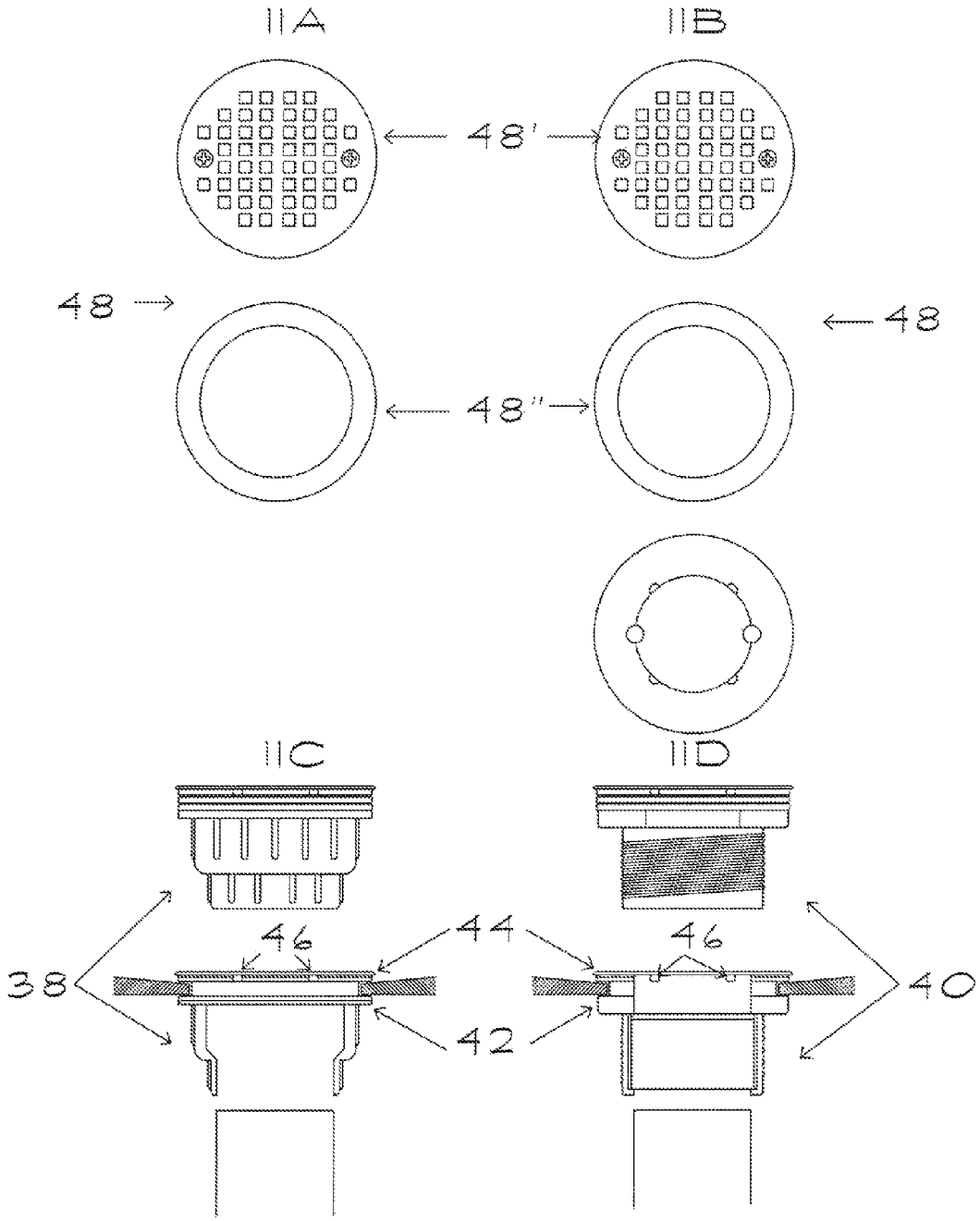
FIG. 11A is a top view of a drain strainer system that may be used with the present invention.
FIG. 11B is a top view of an alternative drain strainer system that may be used with the present invention.
FIG. 11C is a side view of the drain assembly used in conjunction with the strainer system of FIG. 11A.
FIG. 11D is a side view of an alternative drain assembly used in conjunction with the strainer system of FIG. 11B.

To create a waterproof seal between the drain opening 16 and all 2" drain pipes 36, as shown in FIG. 10, a series 825 glue-in drain assembly 38 manufactured by Sioux Chief Manufacturing Company, FIG. 11C, or a series 828 compression drain assembly 40 manufactured by Sioux Chief Manufacturing Company, FIG. 11D, may be used. Each drain assembly, glue-in 38 or compression 40, utilizes a screw on nut and washer system to engage the drain opening 16 of the shower receptor module 10. Both glue-in 38 and compression 40 drain assemblies includes a bottom portion, or locknut 42, a top portion 44, secondary drain system comprised of weep holes 46 and a strainer system 48. The height of the strainer cover 48' on the strainer system 48 can be adjusted to accommodate for tiles of varying thickness by adding additional waterproof gaskets 48" below the strainer cover 48'. The strainer cover 48' may be of a round design, as depicted in FIGS. 11A and 11B; however, other designs such as square and trough can be utilized and the design of the strainer cover 48' is not limited to what is shown or described herein. For instance, in the embodiments illustrated in FIGS. 5-7, a rectangular can be installed over top of the trough area defined by the trench drain system 16' and adjusted for tile height using aluminum or stainless steel washers.

The shower receptor module 10 is installed by first applying a bead of silicone or other appropriate water repellent adhesive to the underside of the top portion 44 of the drain assembly and pushing the assembly firmly down against the drain opening 16. Next, a sealing washer and a friction washer are placed on the threaded end of the top portion 44 of the drain assembly that extends through the drain opening. A locknut 42 is used to engage the sealing and friction washers creating a waterproof seal. The shower receptor module 10 is then set in place, over the drain pipe 36, with the bottom surface of the floor 12 placed against floor joists 50, subfloor or floor within an area defined by framing studs or existing wall 34, FIG. 12. Thin-set may be used to set shower receptor module in place.

For compression drain assembly 40, the compression nut is tightened around the drain pipe 36 to create a waterproof connection. For glue-in drain assembly 38, solvent cement is used to secure the drain assembly to the drain pipe 36 and create a waterproof connection. After the drain assembly is connected, the height of the strainer system is adjusted to sit flush with the tile or stone to be used with the shower receptor system 10.

Figure 12:
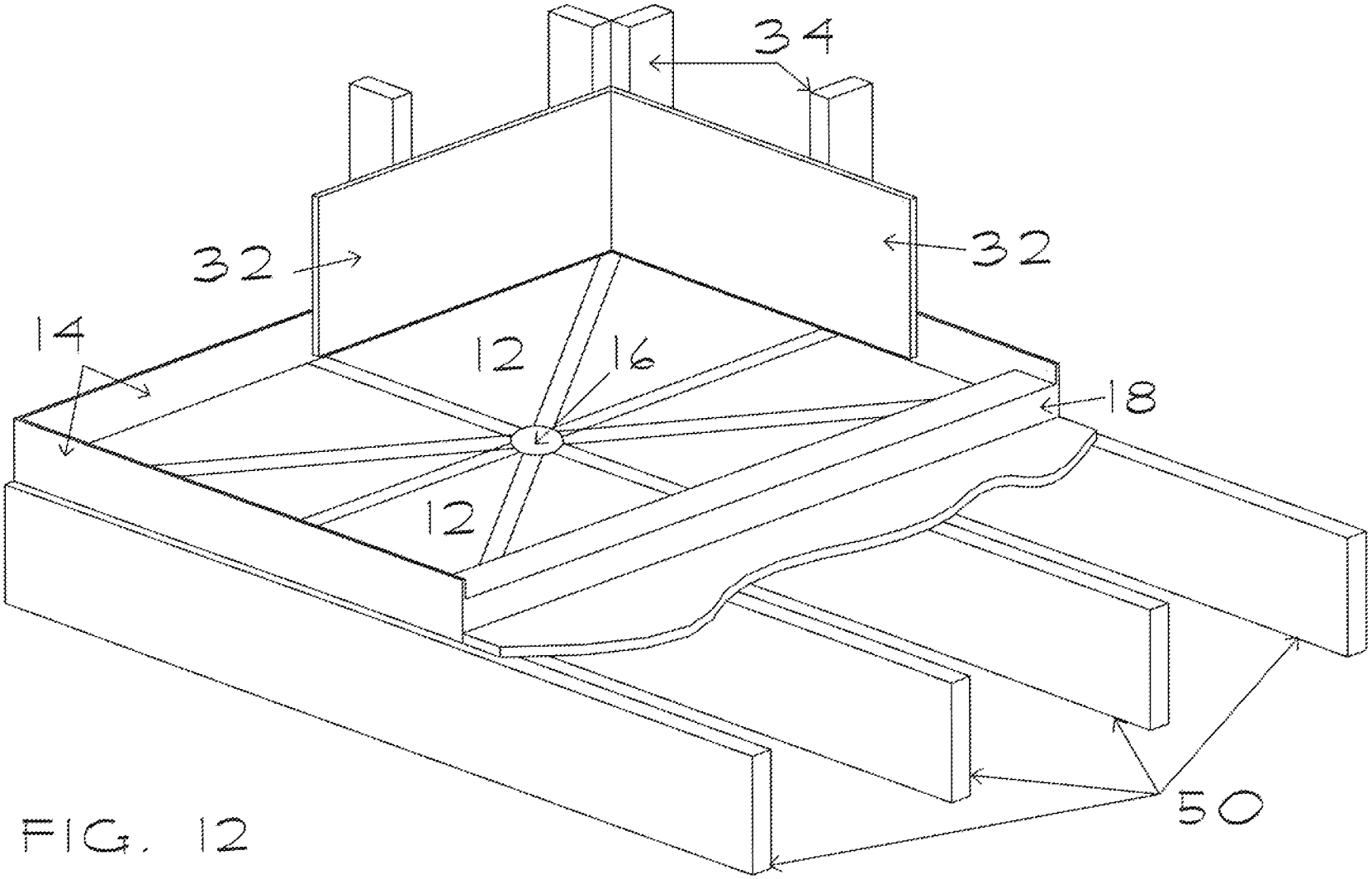
FIG. 12 is a front/top perspective view of a shower receptor module installed over floor joists and within an area defined by framing studs suitable for installation of backer board or green board, in accordance with an alternative embodiment of the present invention.

Concrete backer board or wall board 32 is placed over the side flanges 14 and secured to the framing studs 34, FIG. 12, and tile is applied, as described above.

To re-tile the shower receptor module, grout between the tiles must be removed and then, using a tool with a flat edge such as a chisel, putty knife or screw driver, tiles are lifted with a slight twisting action, or if needed using a hammer. After all tiles have been removed, residue left on the shower receptor module should be removed using sand paper of various grits. The shower receptor module can then be cleaned with a solvent such as acetone. Once dry, new tiles can be applied to the floor and, if applicable, curb and seat, using thin-set adhesive.

What is claimed:

1. An integral one-piece waterproof shower receptor module comprising:

a floor having a plurality of edges and a drain opening and being continuously and upwardly sloped from drain opening to each edge;

a plurality of flanges bonded to a plurality of the edges of the floor, said flanges having a thickness such that, when the flanges abut a surface over which wallboard will be secured, wallboard can overlap the flanges and be secured to the surface such that there is no abutment of a bottom edge of the wallboard to a top edge of a flange and only an insubstantial gap between a backside of the wallboard and the surface to which the wallboard will be secured, the flanges extending directly to the edges of the floor such that the wallboard can extend substantially to the edges of the floor;

wherein the floor comprises a cast, waterproof, non-porous and matrix tile ready substrate formed on an open mold, and has a roughened surface suitable for bonding tile or stone by means of an adhesive, and having a hardness such that removal of the tile or stone by means of an implement such as a screwdriver or chisel will not damage the substrate.

2. In combination with the shower module of claim 1, a drain assembly configured to be received into the drain opening, the drain assembly comprising a bottom portion configured to receive a drain pipe and a top portion water-tightly connectable to the top portion of the shower module, and further comprising a secondary drain system for draining water that may escape below the surface of the tile or stone, and an adjustable height strainer system.

3. The drain assembly of claim 2, wherein the drain assembly comprises a compression fitting configured to engagably receive the drain pipe.

4. The drain assembly of claim 2, wherein the drain assembly comprises a glue-in connection configured to secure the drain assembly to the drain pipe.

5. The shower module of claim 1 further comprising an open molded curb constructed from substantially the same matrix substrate as the floor, the curb being bonded to at least one edge of the floor.

6. The shower module of claim 5, wherein the plurality of flanges bonded to the plurality of the edges of the floor extend a minimum of 1½" above the height of the curb.

7. The shower module of claim 5, wherein the curb extends into an interior of the floor so as to define an offset between an inner vertical wall of the curb and flanges adjacent thereto, the amount of the offset substantially corresponding to a thickness of the wallboard, such that, when installed over the flanges, the wallboard is substantially planarly aligned with the inner vertical wall of the curb.

8. The shower module of claim 1 further comprising an open molded seat and a second plurality of flanges, said seat having a plurality of edges and constructed from substantially the same matrix substrate as the floor, the seat being bonded to at least one edge of the floor and the second plurality of flanges being bonded to the plurality of the edges of the seat.

9. The shower module of claim 8, wherein the plurality of flanges bonded to the plurality of the edges of the floor extend a minimum of 1½" above the height of the floor, and wherein the second plurality of flanges bonded to the plurality of the edges of the seat extend a minimum of 1½" above the height of the seat.

10. The shower module of claim 8, wherein the width of the plurality of flanges bonded to the plurality of the edges of the floor does not exceed ⅛" and the width of the second plurality of flanges bonded to the plurality of the edges of the seat does not exceed ⅛".

11. The shower module of claim 1, further comprising at least one trench cast into the floor and connected to the drain opening.

12. The shower module of claim 1, wherein the plurality of flanges bonded to the plurality of the edges of the floor extend a minimum of 1½" above the height of the floor.

13. The shower module of claim 1, wherein the width of the plurality of flanges bonded to the plurality of the edges of the floor does not exceed ⅛".

14. The shower module of claim 1, wherein the floor has a minimum thickness of ½" at the drain opening.

15. The shower module of claim 1, wherein the floor is upwardly sloped at ¼" per foot from drain opening to the plurality of the edges of the floor.

16. The shower module of claim 1, wherein the matrix substrate is comprised of 50% to 55%, by weight, of unsaturated polyester resin and filled with 45% to 50% of small particles of recycled polyester resin, aluminum trihydrate and calcium carbonate, the matrix substrate further comprising approximately 1 gram of wetting agent for every 1 pound of unsaturated polyester resin, and approximately 0.8 grams of hardening initiator for every 1 pound of unsaturated polyester resin.

17. The shower module of claim 1, wherein the matrix substrate is comprised of approximately 60%, by weight, of unsaturated polyester resin, approximately 31% filler comprised of small particles of recycled polyester resin, aluminum trihydrate and calcium carbonate material and approximately 9% perlite, the matrix substrate further comprising approximately 0.8 grams of hardening initiator for every 1 pound of unsaturated polyester resin.

18. A method of building a shower comprising:

providing an integral one-piece waterproof shower receptor module comprising: a floor having a plurality of edges and a drain opening and being continuously and upwardly sloped from the drain opening to each edge, a plurality of flanges bonded to a plurality of the edges of the floor, said flanges having a thickness such that, when the flanges abut a surface over which wallboard will be secured, the wallboard can overlap the flanges and be secured to the surface such that there is no abutment of the bottom edge of the wallboard to a top edge of a flange, and only an insubstantial gap between a backside of the wallboard and the surface to which the wallboard will be secured, the flanges extending directly to the edges of the floor such that the wallboard can extend substantially to the edges of the floor, wherein the floor comprises a cast, waterproof, non-porous and matrix tile ready substrate formed on an open mold, and has a roughened surface suitable for bonding tile or stone by means of an adhesive, and having a hardness such that removal of the tile or stone by means of an implement such as a screwdriver or chisel will not damage the substrate;

providing, in combination with the shower receptor module, a drain assembly configured to be received into the drain opening, the drain assembly comprising a bottom portion configured to engagably receive a drain pipe and a top portion water-tightly connectable to the top portion of the shower module, and further comprising a secondary drain system for draining water that may escape below the surface of the tile and an adjustable height strainer system;

connecting the drain assembly to the drain opening of the shower module;

installing the shower module directly upon one of a plurality of floor joists, a subfloor or a floor within an area defined by framing studs or one or more existing walls and wherein a drain pipe is disposed within the so defined area;

connecting the drain assembly to the drain pipe;

securing the wallboard to the framing studs or the one or more existing walls such that the wallboard overlaps the flanges and is secured to the surface such that there is no abutment of a bottom edge of the wallboard to a top edge of a flange and only an insubstantial gap between a backside of the wallboard and the surface to which the wallboard will be secured, and such that the wallboard extends substantially to the edges of the floor;

applying adhesive directly to the shower floor and wallboard and applying tile or stone thereon.

19. The method of claim 18, wherein the provided shower module further comprises an open molded seat and a second plurality of flanges, said seat having a plurality of edges and constructed from substantially the same matrix substrate as the floor, the seat being bonded to at least one edge of the floor and the second plurality of flanges being bonded to the plurality of the edges of the seat.

20. The method of claim 18, wherein the shower module further comprises an open molded curb constructed from substantially the same matrix substrate as the floor, the curb being bonded to at least one edge of the floor.

21. The method of claim 18, wherein the shower module comprises at least one trench is cast into the floor and connected to the drain opening.

22. An integral one-piece tile ready waterproof shower receptor module formed by:

pouring a waterproof matrix material onto an open mold corresponding to a desired shape of a shower module, the waterproof matrix material comprised of 50% to 55%, by weight, of unsaturated polyester resin and filled with 45% to 50% of small particles of recycled polyester resin, aluminum trihydrate and calcium carbonate;

adding approximately 1 gram of wetting agent for every 1 pound of polyester resin, and approximately 0.8 grams of hardening initiator for every 1 pound of polyester resin to the waterproof matrix material;

agitating the open mold and allowing the matrix to cure for approximately 24 hours;

roughening surfaces of the module so that they are suitable for bonding tile or stone thereto by means of an adhesive;

bonding a plurality of flanges to the shower module using an adhesive agent comprised of approximately 66.5% laminating resin, approximately 33% fumed silica and approximately 0.5% hardening initiator, by volume.

23. The integral one-piece waterproof shower receptor module formed by the process of claim 22, wherein the waterproof matrix material comprises approximately 60%, by weight, of unsaturated polyester resin, approximately 31% filler comprised of small particles of recycled polyester resin, aluminum trihydrate and calcium carbonate material and approximately 9% perlite, and wherein approximately 0.8 grams of hardening initiator for every 1 pound of polyester resin is added to the waterproof matrix material.

* * * * *